US011835047B2

(12) United States Patent
Kawasaki et al.

(10) Patent No.: US 11,835,047 B2
(45) Date of Patent: Dec. 5, 2023

(54) PUMP APPARATUS

(71) Applicant: Ebara Corporation, Tokyo (JP)

(72) Inventors: Hiroyuki Kawasaki, Tokyo (JP); Takayuki Miyamoto, Tokyo (JP); Miwa Hidekura, Tokyo (JP); Hoechun Kim, Tokyo (JP); Satoshi Yamazaki, Tokyo (JP); Xinshuai Fan, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 17/635,082

(22) PCT Filed: Jun. 10, 2020

(86) PCT No.: PCT/JP2020/022884
§ 371 (c)(1),
(2) Date: Mar. 18, 2022

(87) PCT Pub. No.: WO2021/039025
PCT Pub. Date: Mar. 4, 2021

(65) Prior Publication Data

US 2022/0290675 A1 Sep. 15, 2022

(30) Foreign Application Priority Data

Aug. 28, 2019 (JP) ..... 2019-155673

(51) Int. Cl.
*F04D 15/00* (2006.01)
*F04D 1/00* (2006.01)
(Continued)

(52) U.S. Cl.
CPC ..... *F04D 15/0066* (2013.01); *F04B 49/065* (2013.01); *F04B 49/20* (2013.01);
(Continued)

(58) Field of Classification Search
CPC ..... F04D 15/0066; F04D 25/06; F04D 1/06; F04D 13/06; F04D 27/0261; F04D 15/00;
(Continued)

(56) References Cited

U.S. PATENT DOCUMENTS 4,511,312 A * 4/1985 Hartwig ..... H02K 11/33 417/45
5,240,380 A * 8/1993 Mabe ..... F04D 15/0066 417/43

(Continued)

FOREIGN PATENT DOCUMENTS

JP S6258097 A 3/1987
JP H11-82316 A 3/1999

(Continued)

OTHER PUBLICATIONS

Imaichi et al., "Pump Design Basis," Japan Industrial Publishing Co., Ltd., First Edition, pp. 23-24 (Mar. 25, 1983).

(Continued)

*Primary Examiner* — Peter J Bertheaud
(74) *Attorney, Agent, or Firm* — Leydig, Voit & Mayer, Ltd.

(57) ABSTRACT

The present invention relates to a pump apparatus for delivering a liquid. The pump apparatus includes a pump (1) having an impeller (5), an electric motor (7) for rotating the impeller (5), and an inverter (10) for driving the electric motor (7) at variable speed. The impeller (5) has a non-limit load characteristic in a predetermined discharge flow-rate range (R). The inverter (10) is configured to drive the electric motor (7) at a preset target operating point (TO) with a rotation speed higher than a rotation speed corresponding to a power frequency of a commercial power source.

5 Claims, 7 Drawing Sheets

(51) Int. Cl.

| | |
|---|---|
| ***F04D 13/06*** | (2006.01) |
| ***F04D 29/22*** | (2006.01) |
| ***F04D 1/06*** | (2006.01) |
| ***F04B 49/06*** | (2006.01) |
| ***F04B 49/20*** | (2006.01) |
| ***F04D 27/02*** | (2006.01) |
| ***F04D 25/06*** | (2006.01) |

(52) U.S. Cl.
CPC ..... *F04D 1/00* (2013.01); *F04D 1/06* (2013.01); *F04D 13/06* (2013.01); *F04D 15/00* (2013.01); *F04D 25/06* (2013.01); *F04D 27/0261* (2013.01); *F04D 29/22* (2013.01)

(58) Field of Classification Search
CPC ..... F04D 27/004; F04D 1/00; F04D 29/22; F04B 49/20; F04B 49/065
See application file for complete search history.

(56) References Cited

U.S. PATENT DOCUMENTS

| | | | | |
|---|---|---|---|---|
| 5,563,490 | A * | 10/1996 | Kawaguchi | F04D 15/0066 318/808 |
| 5,634,772 | A | 6/1997 | Kawaguchi | |
| 5,883,489 | A * | 3/1999 | Konrad | F04D 15/0066 318/807 |
| 6,050,780 | A * | 4/2000 | Hasegawa | F04D 25/163 417/423.5 |
| 2002/0018721 | A1 | 2/2002 | Kobayashi et al. | |
| 2011/0223038 | A1* | 9/2011 | Ogawa | F04D 15/0066 417/45 |

FOREIGN PATENT DOCUMENTS

| | | | |
|---|---|---|---|
| JP | H1193881 | A | 4/1999 |
| JP | 2009-273197 | A | 11/2009 |
| JP | 5246458 | B1 | 7/2013 |
| JP | 2002-242844 | A | 8/2022 |
| WO | WO 99/45276 | | 9/1999 |
| WO | WO 2013/125034 | A1 | 8/2013 |

OTHER PUBLICATIONS

Japanese Patent Office, Internatinal Search Report in International Patent Application No. PCT/JP2020/022884 (dated Jul. 28, 2020).
European Patent Office, Extended European Search Report in European Patent Application No. 20856846.9 (dated Aug. 30, 2023).

* cited by examiner

PUMP APPARATUS

CROSS-REFERENCE TO RELATED APPLICATIONS

This patent application is the U.S. national phase of International Application No. PCT/JP2020/022884, filed Jun. 10, 2020, which claims the benefit of Japanese Patent Application No. 2019-155673, filed on Aug. 28, 2019, each of which are incorporated by reference in their entireties herein.

TECHNICAL FIELD

The present invention relates to a pump apparatus for delivering a liquid, and more particularly to a pump apparatus including an impeller having a non-limit load characteristic.

BACKGROUND ART

Pump apparatuses for delivering liquids are used in various applications. A head, a flow rate, etc. required for each pump apparatus may vary depending on the application of the pump apparatus. An operating point, which is defined by the head and the flow rate, is one of factors for selecting a pump apparatus.

However, considering running costs of the pump apparatus, it is insufficient to select the pump apparatus based only on the operating point. Specifically, a pump efficiency should also be included as a factor for selecting a pump apparatus, and it is important to select a pump apparatus having a high pump efficiency. In particular, from a viewpoint of energy saving, there has recently been an increasing demand for a pump apparatus that can be driven with less power while achieving a required operating point.

CITATION LIST

Patent Literature

Patent document 1: Japanese Patent No. 5246458

Patent document 2: Japanese laid-open patent publication No. 2009-273197

SUMMARY OF INVENTION

Technical Problem

Therefore, the present invention provides an improved pump apparatus capable of achieving a high pump efficiency and energy saving.

Solution to Problem

In an embodiment, there is provided a pump apparatus comprising: a pump having an impeller; an electric motor configured to rotate the impeller; and an inverter configured to drive the electric motor at variable speed, wherein the impeller has a non-limit load characteristic in a predetermined discharge flow-rate range, and the inverter is configured to drive the electric motor at a preset target operating point with a rotation speed higher than a rotation speed corresponding to a power frequency of a commercial power source.

In an embodiment, the inverter is configured to drive the electric motor at a first rotation speed when a discharge flow rate of a liquid from the pump is lower than a preset flow rate, and to drive the electric motor at a second rotation speed when the discharge flow rate is higher than the preset flow rate, the second rotation speed is lower than the first rotation speed, and the preset flow rate is in the discharge flow-rate range.

In an embodiment, the second rotation speed is such that a shaft power required for the electric motor is equal to or lower than a rated power of the electric motor.

In an embodiment, the second rotation speed is higher than the rotation speed corresponding to the power frequency of the commercial power source.

In an embodiment, a peak point of a pump efficiency is adjacent to an upper limit of the discharge flow-rate range or on the upper limit of the discharge flow-rate range.

In an embodiment, the inverter is configured to increase the rotation speed of the electric motor as long as a shaft power required for the electric motor does not exceed a rated power of the electric motor.

Advantageous Effects of Invention

According to the present invention, a high pump efficiency and energy saving can be achieved by the combination of the impeller having the non-limit load characteristic and the high-speed driving of the electric motor by the inverter.

DESCRIPTION OF EMBODIMENTS

Hereinafter, embodiments of the present invention will be described with reference to the drawings.

Figure 1:
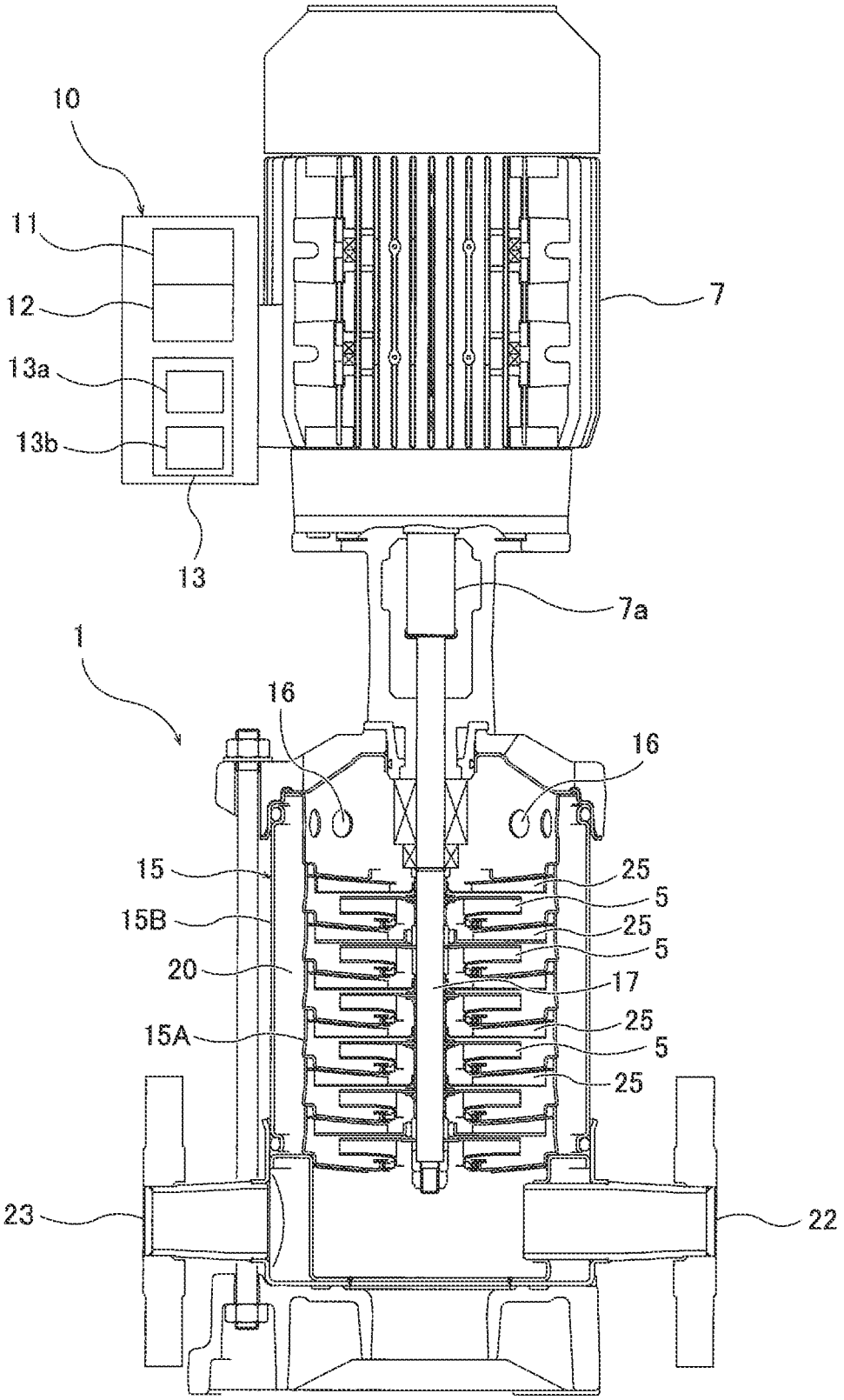
FIG. 1 is a cross-sectional view showing an embodiment of a pump apparatus.

FIG. 1 is a cross-sectional view showing an embodiment of a pump apparatus. The pump apparatus described below is a multi-stage pump apparatus having a plurality of impellers, but the present invention is not limited to the embodiments described below, and is also applicable to a single-stage pump apparatus having a single impeller. Further, the present invention can be applied not only to a land-based pump apparatus as shown in FIG. 1 but also to a submersible motor pump apparatus (for example, for fresh water, for civil engineering work, for sewage).

As shown in FIG. 1, the pump apparatus of the present embodiment includes a pump 1 having impellers 5, an electric motor 7 for rotating the impellers 5, and an inverter 10 for driving the electric motor 7 at a variable speed. The pump 1 includes a casing 15 having an inner casing 15A and an outer casing 15, the plurality of impellers 5 arranged in the casing 15, and a rotating shaft 17 to which these impellers 5 are fixed. The rotating shaft 17 is coupled to a drive shaft 7*a* of the electric motor 7.

The impellers 5 are arranged in the inner casing 15A, and the inner casing 15A is arranged in the outer casing 15B. The outer casing 15B surrounds the entire inner casing 15A, and a flow passage 20 for a liquid is formed between the inner casing 15A and the outer casing 15B. A plurality of through-holes 16 are formed in an end of the inner casing 15A, so that the interior of the inner casing 15A and the flow passage 20 communicate with each other through these through-holes 16. The casing 15 has a suction port 22 communicating with the interior of the inner casing 15A and further has a discharge port 23 communicating with the flow passage 20.

The impellers 5 are arranged in series facing toward the suction port 22. The pump 1 further includes a plurality of diffusers 25 arranged at back sides (downstream sides) of the plurality of impellers 5, respectively. When the electric motor 7 rotates the rotating shaft 17 and the impellers 5, the liquid flows into the inner casing 15A through the suction port 22, and the rotating impellers 5 imparts kinetic energy to the liquid. The kinetic energy is converted to pressure as the liquid passes through the diffusers 25. The liquid is pressurized by the impellers 5 and the diffusers 25, moves into the flow passage 20 through the through-holes 16, flows through the flow passage 20, and is discharged through the discharge port 23.

The inverter 10 includes an AC-DC converter section 11 to which electric power is supplied from a commercial power source, a DC-AC inverter section 12 having semiconductor elements (switching elements) such as IGBT, and a controller 13 configured to control operation of the entire inverter 10. In FIG. 1, the inverter 10 is schematically depicted. The operation of the DC-AC inverter section 12 is controlled by the controller 13. The controller 13 includes a memory 13*a* storing programs therein, and a processer 13*b* configured to perform arithmetic operations according to instructions included in the programs. The memory 13*a* includes a main memory, such as RAM, and an auxiliary memory, such as a hard disk drive (HDD) or a solid-state drive (SSD). Examples of the processer 13*b* include a CPU (central processing unit) and a GPU (graphic processing unit).

Figure 2:
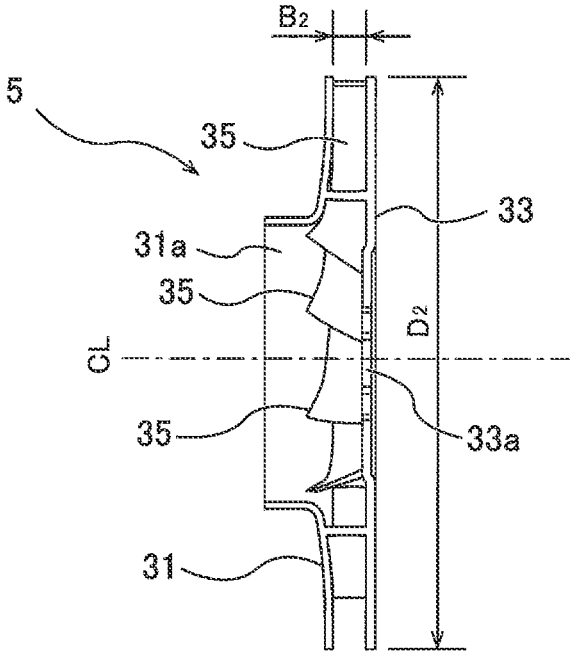
FIG. 2 is a cross-sectional view of the impeller shown in FIG. 1.
Figure 3:
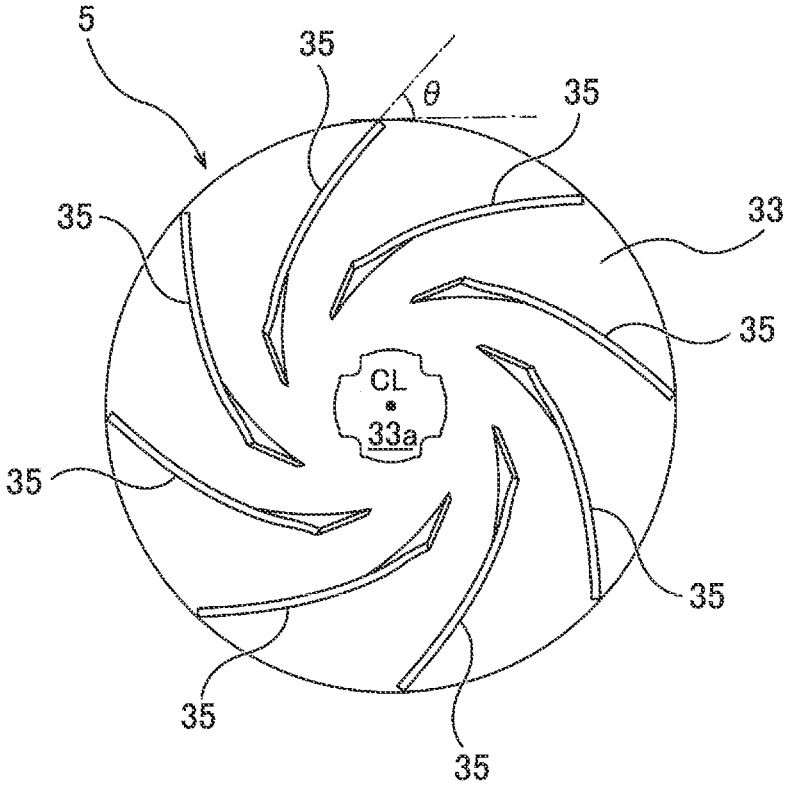
FIG. 3 is a front view of an impeller.

FIG. 2 is a cross-sectional view of the impeller 5 shown in FIG. 1, and FIG. 3 is a front view of the impeller 5. The impeller 5 includes a side plate 31 having a liquid inlet 31*a*, a main plate 33 having an engagement hole 33*a* into which the rotating shaft 17 is inserted, and a plurality of vanes 35 arranged between the side plate 31 and the main plate 33. In FIG. 3, the side plate 31 is not shown. A symbol $D_2$ in FIG. 2 represents a diameter of the impeller 5. A symbol $B_2$ in FIG. 2 represents a height of the vanes 35, i.e., an axial dimension of outlet ends of the vanes 35. The height $B_2$ of the vanes 35 corresponds to a distance between the side plate 31 and the main plate 33 at a liquid outlet of the impeller 5.

Each vane 35 has a shape twisted along a flow direction of the liquid, i.e., a three-dimensional shape. More specifically, an inlet end of each vane 35 is inclined with respect to a central axis CL of the impeller 5 as viewed from the axial direction of the impeller 5. The impeller 5 having such three-dimensionally shaped vanes 35 can improve a pump efficiency. Furthermore, an angle θ between the outlet end of each vane 35 and a tangential direction of the main plate 33 is larger than that of a conventional impeller described later. As the angle θ increases, a peak point of a shaft power of the impeller 5 moves to a high flow-rate side. Specifically, the impeller 5 having a large angle θ has a non-limit load characteristic over a wide operating range.

Figure 4:
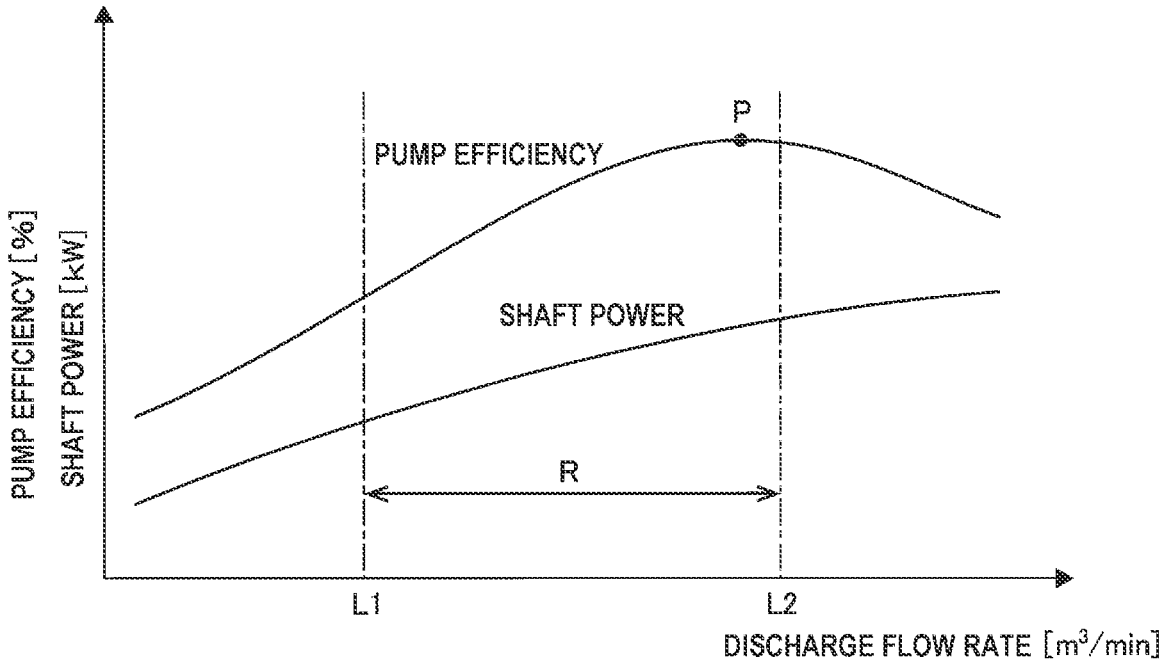
FIG. 4 is a graph showing a relationship between shaft power, pump efficiency, and discharge flow rate.

FIG. 4 is a graph showing a relationship between shaft power, pump efficiency, and discharge flow rate. The impeller 5 of the present embodiment has a non-limit load characteristic within a predetermined discharge flow-rate range R. Specifically, when the impeller 5 is rotated at a constant speed, the shaft power [kW] required for the electric motor 7 to rotate the impeller 5 increases with the increase in the discharge flow rate [$m^3$/min] of the impeller 5 within the discharge flow-rate range R, as shown in FIG. 4. In FIG. 4, a lower limit of the discharge flow-rate range R is represented by a symbol L1, and an upper limit is represented by a symbol L2. The discharge flow-rate range R is a flow-rate range corresponding to a rated operating range of the pump 1.

The impeller 5 having the non-limit load characteristic can improve the pump efficiency. On the other hand, during the operation of the pump apparatus, the shaft power may exceed a rated power of the electric motor 7. Therefore, the inverter 10 is configured to limit the electric power supplied to the electric motor 7 to the rated power or less of the electric motor 7. The inverter 10 having such configuration can prevent excessive power consumption and can prevent failure of the electric motor 7 due to overload.

As shown in FIG. 4, a peak point P of the pump efficiency [%], which is the highest efficiency point of the pump 1, exists within the discharge flow-rate range R. The peak point P is adjacent to the upper limit L2 of the discharge flow-rate range R. The peak point P is preferably as close to the upper limit L2 of the discharge flow-rate range R as possible. When a high pump efficiency can be achieved at an operating point where the highest shaft power is reached, the electric power required for the operation of the pump 1 can be reduced. Therefore, according to the present embodiment, the energy saving of the electric motor 7 can be achieved. The peak point P may be on the upper limit L2 of the discharge flow-rate range R. In one embodiment, the peak point P may exceed the upper limit L2 of the discharge flow-rate range R and may be adjacent to the upper limit L2.

Figure 5:
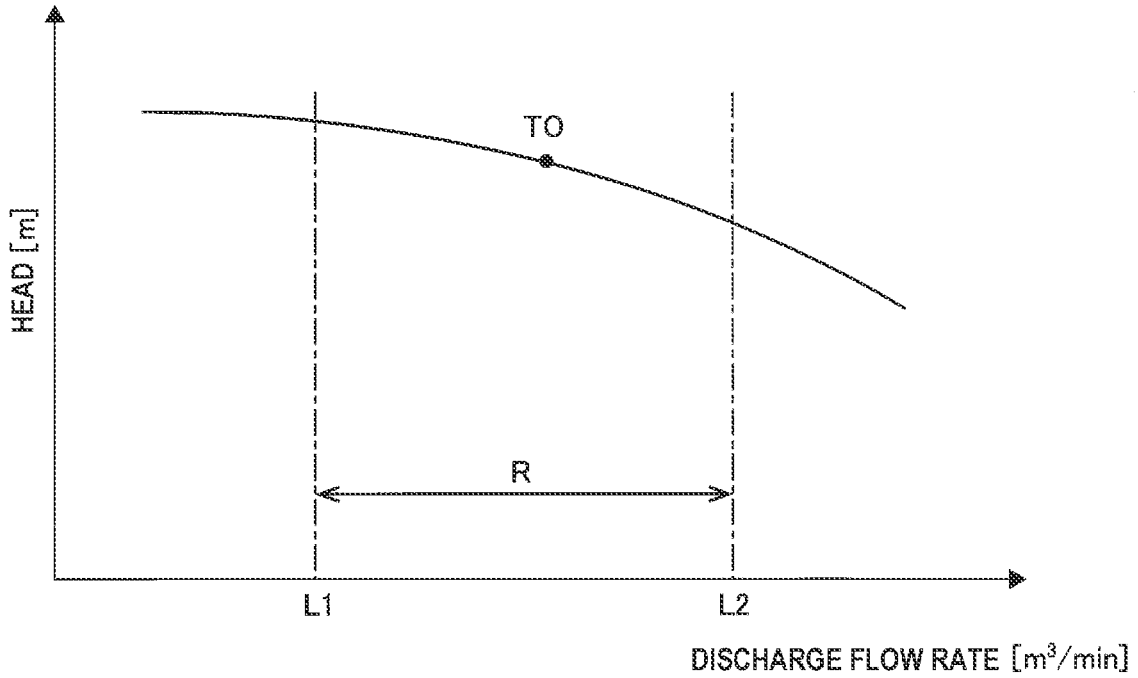
FIG. 5 is a graph showing a performance curve of a pump.

FIG. 5 is a graph showing a performance curve of the pump 1. The impeller 5 has a shape (i.e., a specific speed) that can achieve a required operating point (hereinafter referred to as a target operating point TO). In other words, the impeller 5 is designed to have a shape (specific speed) capable of achieving the target operating point TO. The target operating point TO is an operating point located within the discharge flow-rate range R. The rotation speed of the impeller 5 when the pump 1 is operated at the target operating point TO is higher than a rotation speed corresponding to a frequency (50 Hz or 60 Hz) of the commercial power source. Specifically, the inverter 10 is configured to drive the electric motor 7 at a rotation speed higher than the rotation speed corresponding to the frequency (50 Hz or 60 Hz) of the commercial power source at the target operating point TO, so that the electric motor 7 rotates the impeller 5 at a rotation speed higher than the rotation speed corresponding to the frequency (50 Hz or 60 Hz) of the commercial power source at the target operating point TO.

As described above, the combination of the inverter 10 and the electric motor 7 enables the impeller 5 to rotate at a rotation speed higher than that of a pump apparatus having no inverter. Therefore, the impeller 5 is allowed to have a higher specific speed than that of a general impeller capable of achieving the target operating point TO. More specifically, the impeller 5 can have a diameter $D_2$ (see FIG. 2) smaller than that of a typical impeller capable of achieving the target operating point TO shown in FIG. 5. The impeller 5 having the small diameter $D_2$ contributes to downsizing of the entire pump 1.

In general, the higher the specific speed, the higher the pump efficiency. In the predetermined discharge flow-rate range R, the inverter 10 of the present embodiment drives the electric motor 7 at a rotation speed higher than the rotation speed corresponding to the frequency (50 Hz or 60 Hz) of the commercial power supply, and the electric motor 7 rotates the impeller 5 at a rotation speed higher than the rotation speed corresponding to the frequency (50 Hz or 60 Hz) of the commercial power source in the discharge flow-rate range R. The discharge flow-rate range R is the rated operating range of the pump 1. Since the inverter 10 drives the electric motor 7 at a high rotation speed in this rated operating region (i.e., in the discharge flow-rate range R), the impeller 5 is allowed to have a high specific speed with good pump efficiency. In addition, the diameter of the impeller 5 can be made smaller than that of other impeller that can achieve the same flow rate and the same head.

Figure 6:
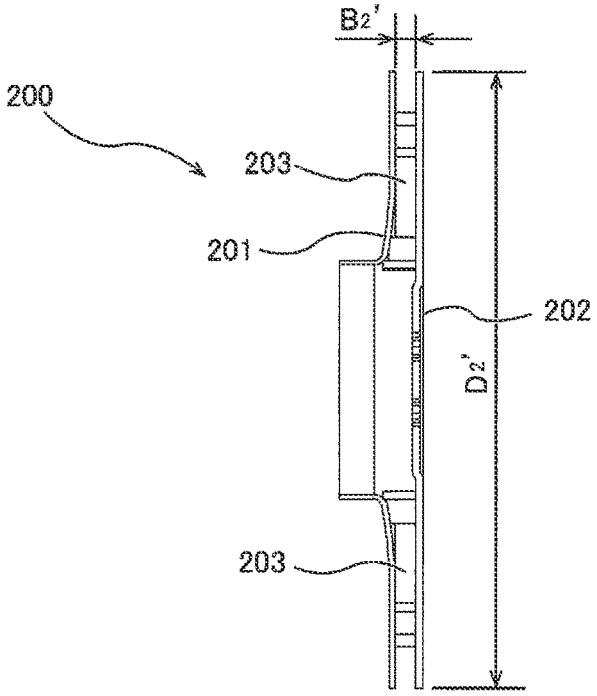
FIG. 6 is a cross-sectional view showing an impeller of a general pump apparatus that can achieve the same target operating point as the impeller of the present embodiment and does not have an inverter.
Figure 7:
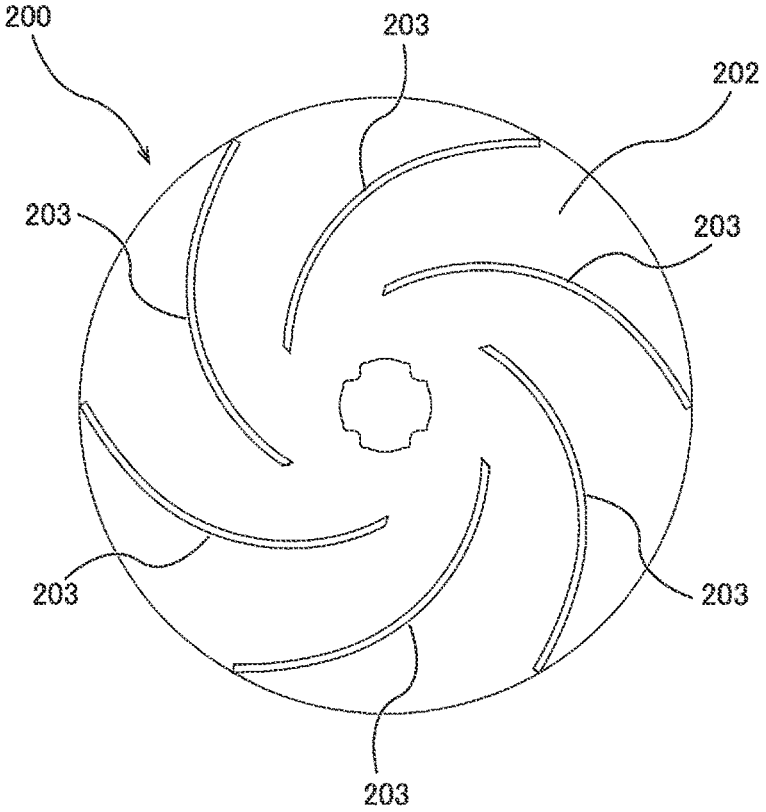
FIG. 7 is a front view of the impeller shown in FIG. 6.

FIG. 6 is a cross-sectional view showing an impeller 200 of a general pump apparatus which can achieve the same target operating point TO as the impeller 5 of the present embodiment and does not have an inverter, and FIG. 7 is a front view showing the impeller 200 shown in FIG. 6. Reference numeral 201 represents a side plate, reference numeral 202 represents a main plate, and reference numeral 203 represents a vane. In FIG. 7, the depiction of the side plate is omitted.

The impeller 200 of the pump apparatus having no inverter is rotated at a rotation speed corresponding to the frequency (50 Hz or 60 Hz) of the commercial power source. The impeller 200 of FIG. 6 is designed to achieve the same target operating point TO, but has a lower specific speed than that of the impeller 5 of the present embodiment.

The impeller 5 of the present embodiment shown in FIG. 2 has the diameter $D_2$ smaller than a diameter $D_2'$ of the impeller 200 shown in FIG. 6 ($D_2<D_2'$). Further, the height $B_2$ of the vanes 35 of the impeller 5 of the present embodiment is larger than a height $B_2'$ of the vanes 203 of the impeller 200 shown in FIG. 6 ($B_2>B_2'$). The impeller 5 of the present embodiment having such configurations has a higher specific speed than that of the impeller 200 shown in FIG. 6. In general, the higher the specific speed, the higher the pump efficiency. Therefore, the pump efficiency of this embodiment is higher than the pump efficiency of the impeller 200 shown in FIGS. 6 and 7.

As can be seen from the comparison between FIG. 2 and FIG. 6, the entire impeller 5 of the present embodiment shown in FIG. 2 is more compact than the general impeller 200 shown in FIG. 6. Therefore, such impeller 5 can not only improve the pump efficiency of the pump 1 but also achieve the downsizing of the pump 1.

In addition, the reduction of the diameter of the impeller 5 can lower a loss due to a disk friction, and as a result, the pump efficiency can be improved. The pump efficiency is generally expressed as:

$$\text{Pump efficiency}=\text{hydro-theoretical efficiency}-\text{various losses} \quad (1)$$

where the hydro-theoretical efficiency is obtained by a formula for calculating the pump efficiency. The various losses include losses due to various factors, and a loss due to the disk friction greatly affects the pump efficiency. The disk friction is a friction between an impeller and a liquid. The disk friction is calculated by the following equation.

$$\text{Disk friction}=Cd\times\rho\times U_2^3\times D_2^2\times(1+5e/D_2) \quad (2)$$

where Cd is a drag coefficient with respect to Reynolds number, ρ is a density of the liquid, $U_2$ is a circumferential velocity of the impeller [m/s], $D_2$ is a diameter of the impeller [m], and e is a sum [m] of a thickness of the side plate and a thickness of the main plate of the impeller.

As can be seen from the above equation (2), the smaller the diameter $D_2$ of the impeller, the smaller the disk friction. Therefore, the pump efficiency obtained from the equation (1) is improved as the diameter of the impeller becomes smaller. Since the impeller 5 of the present embodiment has a small diameter, the disk friction is small, and as a result, the pump efficiency can be improved.

As described above, the impeller 5 of the present embodiment includes the vanes 35 each having the three-dimensional shape and has the non-limit load characteristic. The impeller 5 designed to have such configurations can significantly improve the pump efficiency. Further, by operating the pump at a higher rotation speed, the number of stages of the impellers 5 can be reduced by about 40% as compared with the conventional pump apparatus that can achieve the same flow rate and the same head. Specifically, according to the present embodiment, the pump efficiency of the pump apparatus can be improved and the downsizing of the pump apparatus can also be achieved.

In one embodiment, each vane 35 may not have the three-dimensional shape as long as the impeller 5 has the non-limit load characteristic. Specifically, the inlet end of each vane 35 is parallel to the central axis CL of the impeller 5 as viewed from the axial direction of the impeller 5, and the angle θ (see FIG. 3) between the outlet end of each vane 35 and the tangential direction of the main plate 33 is designed to be large enough to allow the impeller 5 to have a non-limit load characteristic within the discharge flow-rate range R.

Figure 8:
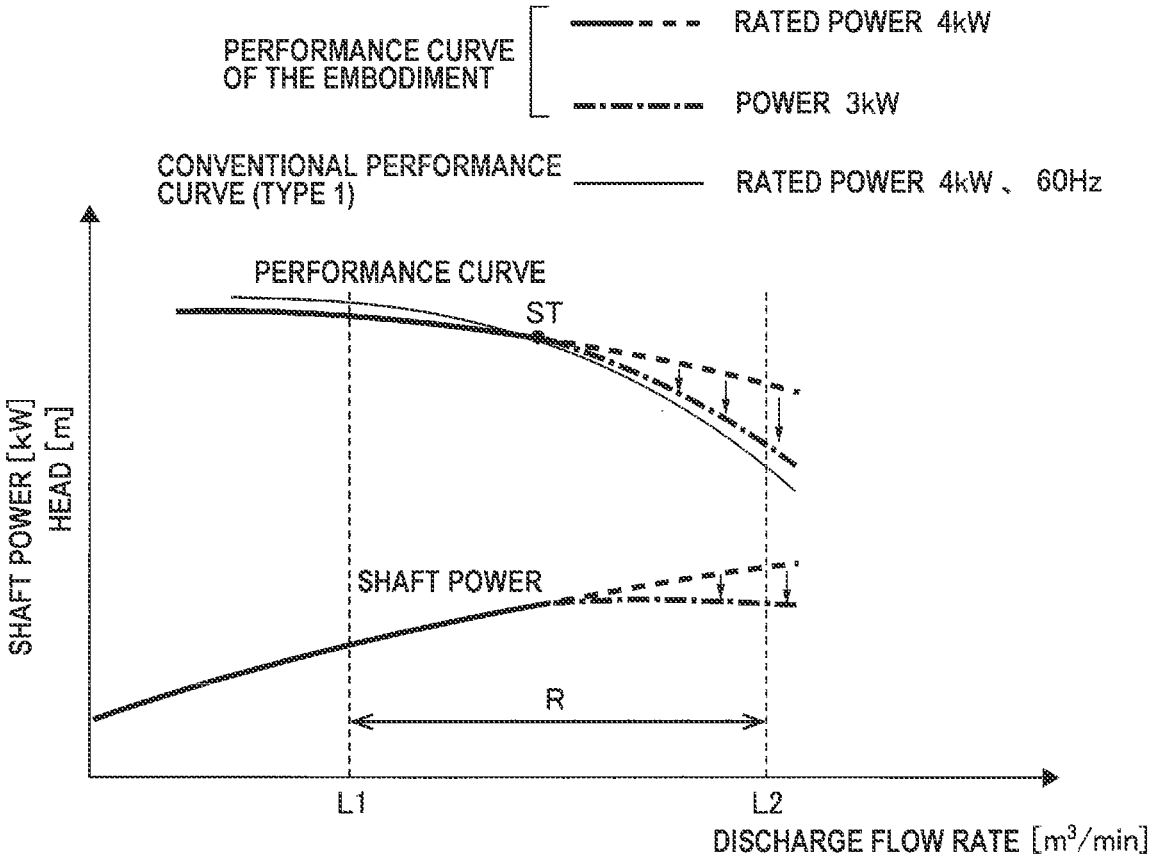
FIG. 8 is a diagram illustrating an embodiment of operation of the inverter within a discharge flow-rate range (rated operation range)

Next, an embodiment of the operation of the inverter 10 in the discharge flow-rate range R (rated operating range) will be described with reference to FIG. 8. In FIG. 8, a thick line represents a performance curve of the pump apparatus of the present embodiment, and a thin line represents a performance curve of a general pump apparatus having no inverter. In this example, the rated power of the electric motor 7 of this embodiment is 4.0 kW. On the other hand, the rated power of the electric motor of the conventional pump apparatus shown by the thin line is 4 kW, the power frequency is 60 Hz, and the conventional pump apparatus rotates at a fixed speed (type 1).

Since the impeller 5 of the present embodiment has the non-limit load characteristic, the shaft power increases as the discharge flow rate increases. Therefore, in order to prevent an overload on the electric motor 7, the inverter 10 of the present embodiment is configured to drive the electric motor 7 at a first rotation speed when a discharge flow rate of the liquid from the pump 1 is smaller than a preset flow rate ST and to drive the electric motor 7 at a second rotation speed when the discharge flow rate is higher than the preset flow rate ST. The second rotation speed is lower than the first rotation speed. The preset flow rate ST is equal to or more than the lower limit L1 and less than the upper limit L2 of the discharge flow-rate range R.

The first rotation speed and the second rotation speed are higher than a rotation speed corresponding to the power frequency (50 Hz or 60 Hz) of the commercial power source. The second rotation speed is such that the shaft power required for the electric motor 7 is equal to or less than the rated power of the electric motor 7. The second rotation speed may be a fixed rotation speed or may fluctuate within a range lower than the first rotation speed.

As can be seen from the graph of FIG. 8, when the rotation speed of the electric motor 7 is lowered from the first rotation speed to the second rotation speed by the inverter 10, the operating point of the pump 1 is lowered, and the performance curve of the pump 1 (indicated by the thick line) approaches the performance curve (indicated by the thin line) of the conventional pump apparatus. The pump apparatus of the present embodiment that performs such rotation control of the inverter 10 can achieve the same performance curve as the conventional pump apparatus. Furthermore, by reducing the rotation speed of the impeller 5 from the first rotation speed to the second rotation speed, the shaft power is reduced, and the output power of the electric motor 7 (rated power 4 kW) is reduced to 3 kW. As a result, not only the overload on the electric motor 7 can be prevented, but also the power consumption can be reduced as compared with the electric motor (rated power 4 kW) of the conventional pump apparatus. Specifically, the combination of the rotation control by the inverter 10 and the impeller 5 having the non-limit load characteristic allows the pump 1 to perform a pump operation as if the impeller 5 has a limit load characteristic.

Figure 9:
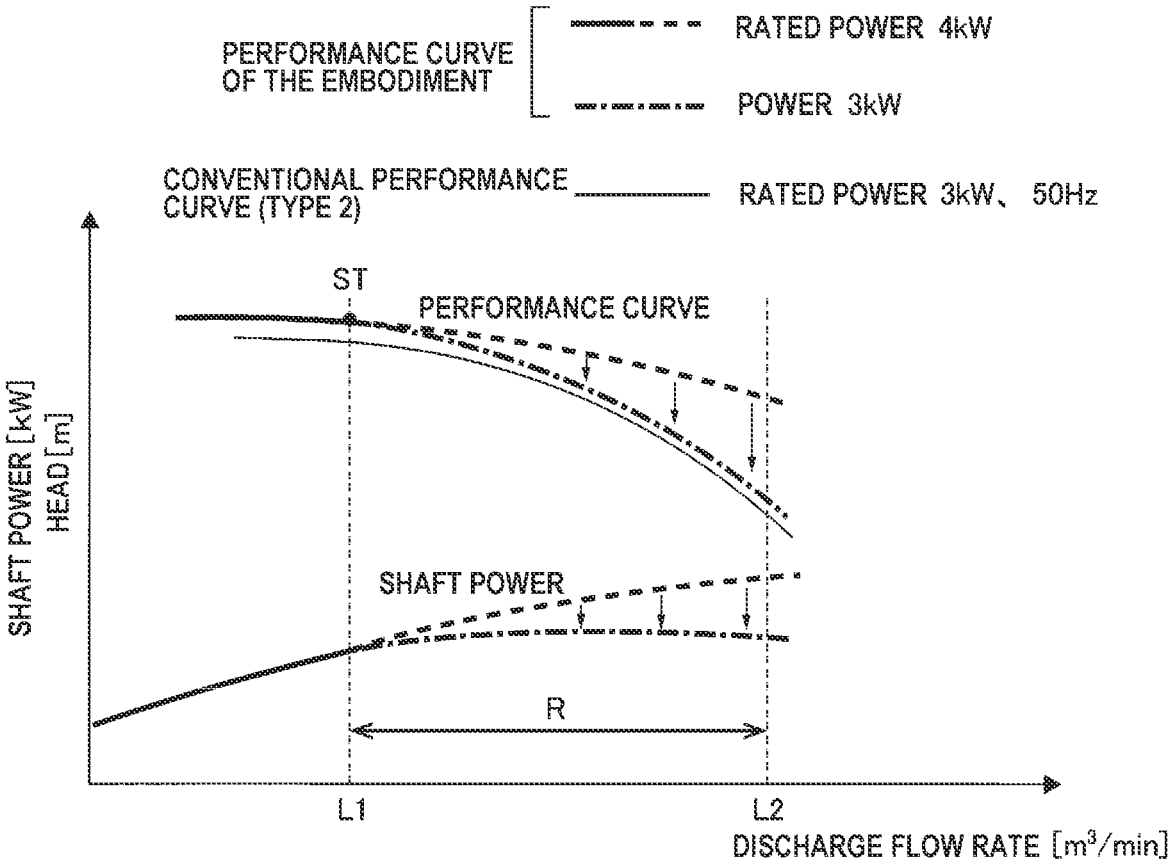
FIG. 9 is a diagram illustrating another embodiment of the operation of the inverter within the discharge flow-rate range (rated operation range)

FIG. 9 is a graph showing another embodiment of the operation of the inverter 10 in the discharge flow-rate range R (rated operation range). In FIG. 9, a thick line represents a performance curve of the pump apparatus of the present embodiment, and a thin line represents a performance curve of a general pump apparatus having no inverter. In this example, the rated power of the electric motor 7 of the present embodiment is 4.0 kW, which is the same as the example of FIG. 8. On the other hand, the rated power of the electric motor of the conventional pump apparatus shown by the thin line is 3 kW, the power frequency is 50 Hz, and the conventional pump apparatus rotates at a fixed speed (type 2).

Similar to the embodiment of FIG. 8, the inverter 10 is configured to drive the electric motor 7 at a first rotation speed when the discharge flow rate of the liquid from the pump 1 is smaller than a preset flow rate ST, and to drive the electric motor 7 at a second rotation speed when the discharge flow rate is higher than the preset flow rate ST. The second rotation speed is lower than the first rotation speed. The first rotation speed and the second rotation speed are higher than a rotation speed corresponding to the power frequency (50 Hz or 60 Hz) of the commercial power source. The second rotation speed is such that the shaft power required for the electric motor 7 is equal to or less than the rated power of the electric motor 7. In the embodiment shown in FIG. 9, the preset flow rate ST is the lower limit L1 of the discharge flow-rate range R. Therefore, the inverter 10 drives the electric motor 7 at the second rotation speed while the discharge flow rate of the pump 1 is within the discharge flow-rate range R. The second rotation speed may be a fixed rotation speed or may fluctuate within a range lower than the first rotation speed.

As can be seen from the graph of FIG. 9, when the rotation speed of the electric motor 7 is lowered from the first rotation speed to the second rotation speed by the inverter 10, the operating point of the pump 1 is lowered, and the performance curve of the pump 1 (indicated by the thick line) approaches the performance curve (indicated by the thin line) of the conventional pump apparatus. Further, by reducing the rotation speed of the impeller 5 from the first rotation speed to the second rotation speed, the shaft power is reduced, and the output power of the electric motor 7 (rated power 4 kW) is reduced to 3 kW. As a result, not only the overload on the electric motor 7 can be prevented, but also the power consumption equivalent to that of the electric motor (rated power 3 kW) of the conventional pump apparatus can be achieved.

As described above, the pump apparatus of the present embodiment can cover the operating ranges of two conventional pump apparatuses having different performance curves as shown by the thin lines in FIGS. 8 and 9 by appropriately controlling the rotation speed of the electric motor 7 by the inverter 10. Moreover, the pump apparatus of the present embodiment can achieve the same or smaller power consumption as the conventional pump apparatuses.

Figure 10:
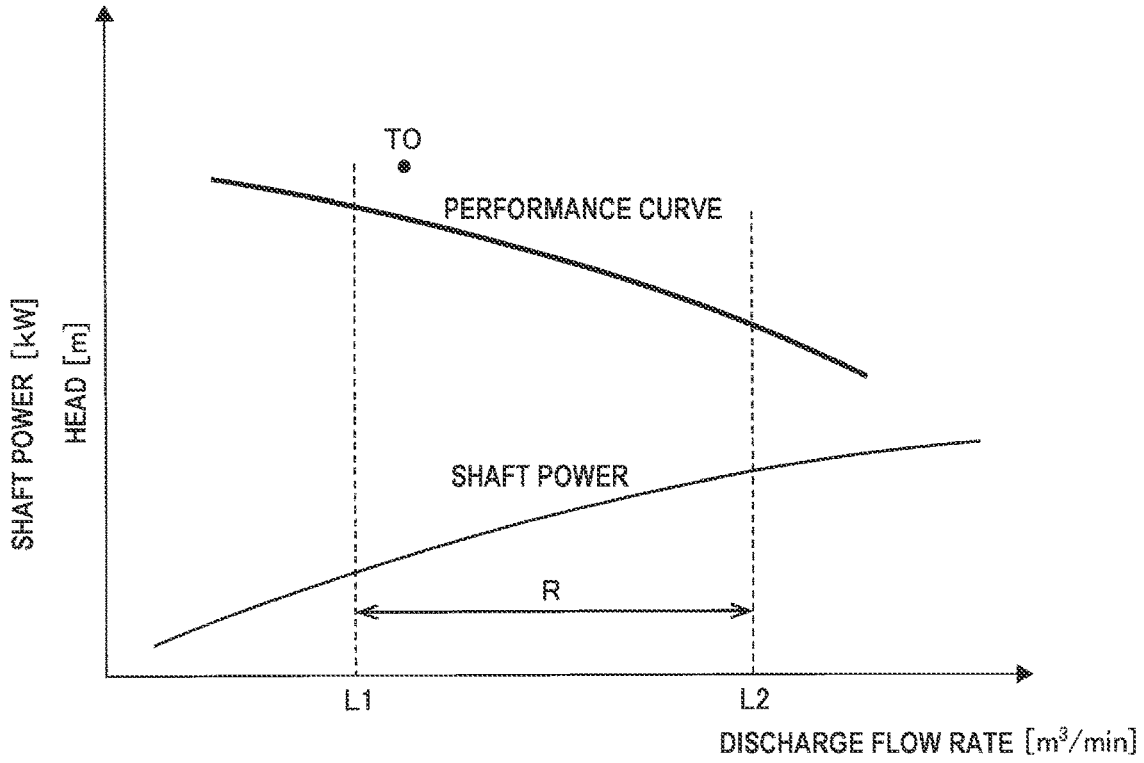
FIG. 10 is a diagram illustrating still another embodiment of the operation of the inverter within the discharge flow-rate range (rated operation range)
Figure 11:
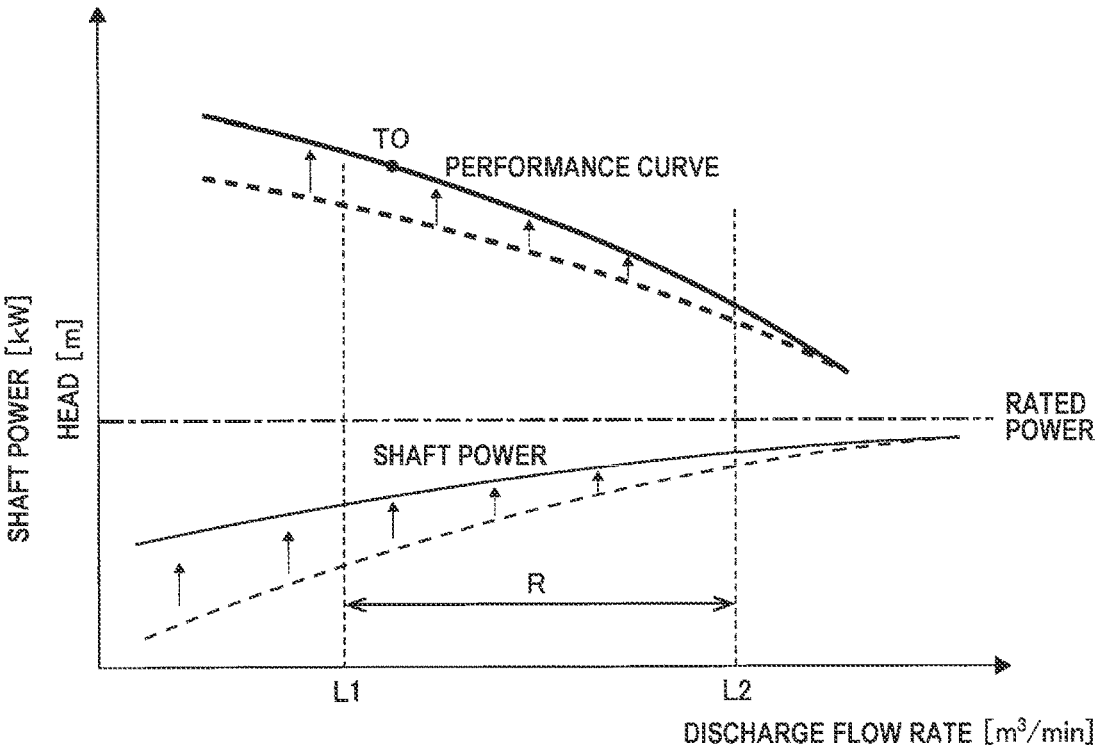
FIG. 11 is a diagram illustrating a manner in which the inverter increases a rotation speed of an electric motor as long as the shaft power does not exceed a rated power of the electric motor.

FIG. 10 is a graph showing still another embodiment of the operation of the inverter 10 within the discharge flow-rate range R (rated operating range). In the example shown in FIG. 10, the required operating point, i.e., the target operating point TO, is above the performance curve. Therefore, in order to move the performance curve upward in the discharge flow-rate range R, as shown in FIG. 11, the inverter 10 increases a rotation speed of the electric motor 7 as long as the shaft power does not exceed the rated power of the electric motor 7. As a result, the performance curve rises, and the operating point of the pump 1 can reach the target operating point TO.

As described above, the pump apparatus having the combination of the rotation control of the electric motor 7 (i.e., the impeller 5) by the inverter 10 and the impeller 5 having the non-limit load characteristic can cover a wide operating range. In addition, the pump efficiency can be improved, and the pump apparatus can be downsized.

The operation of the inverter 10 of each of the above-described embodiments is performed according to the program stored in the memory 13*a* of the controller 13 shown in FIG. 1. More specifically, the processer 13*b* of the controller 13 performs the arithmetic operations according to the instructions included in the program to cause the inverter 10 to perform the operation described in each of the above-described embodiments.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

INDUSTRIAL APPLICABILITY

The present invention is applicable to a pump apparatus for delivering a liquid.

REFERENCE SIGNS LIST

1 pump
5 impeller
7 electric motor
10 inverter

11 AC-DC converter section
12 DC-AC inverter section
13 controller
13*a* memory
13*b* processor
15 casing
15A inner casing
15B outer casing
16 through-hole
17 rotating shaft
20 flow passage
22 suction port
23 discharge port
25 diffuser
31 side plate
33 main plate
35 vane

The invention claimed is:

1. A pump apparatus comprising:

a pump having an impeller;

an electric motor configured to rotate the impeller; and an inverter configured to drive the electric motor at variable speed, wherein the impeller has a non-limit load characteristic in a predetermined discharge flow-rate range, and the inverter is configured to drive the electric motor at a preset target operating point with a rotation speed higher than a rotation speed corresponding to a power frequency of a commercial power source, wherein the inverter is configured to drive the electric motor at a first rotation speed when a discharge flow rate of a liquid from the pump is lower than a preset flow rate, and to drive the electric motor at a second rotation speed when the discharge flow rate is higher than the preset flow rate, the second rotation speed is lower than the first rotation speed, and the preset flow rate is in the discharge flow-rate range.

2. The pump apparatus according to claim 1, wherein the second rotation speed is such that a shaft power required for the electric motor is equal to or lower than a rated power of the electric motor.

3. The pump apparatus according to claim 1, wherein the second rotation speed is higher than the rotation speed corresponding to the power frequency of the commercial power source.

4. The pump apparatus according to claim 1, wherein a peak point of a pump efficiency is adjacent to an upper limit of the discharge flow-rate range or on the upper limit of the discharge flow-rate range.

5. A pump apparatus comprising:

a pump having an impeller;

an electric motor configured to rotate the impeller; and an inverter configured to drive the electric motor at variable speed, wherein the impeller has a non-limit load characteristic in a predetermined discharge flow-rate range, and the inverter is configured to drive the electric motor at a preset target operating point with a rotation speed higher than a rotation speed corresponding to a power frequency of a commercial power source, wherein the inverter is configured to increase the rotation speed of the electric motor as long as a shaft power required for the electric motor does not exceed a rated power of the electric motor.

* * * * *